US006904832B1

(12) United States Patent
Chen

(10) Patent No.: US 6,904,832 B1
(45) Date of Patent: Jun. 14, 2005

(54) RATCHET WRENCH

(76) Inventor: Yu Tang Chen, No.1, Alley 16, Lane 40, Jinn Te Rd., Taichung (TW)

( * ) Notice: Subject to any disclaimer, the term of this patent is extended or adjusted under 35 U.S.C. 154(b) by 0 days.

(21) Appl. No.: 10/666,983

(22) Filed: Sep. 16, 2003

(51) Int. Cl.[7] ..... B25B 13/46
(52) U.S. Cl. ..... 81/63.2; 81/63; 81/63.1
(58) Field of Search ..... 81/63.2, 63, 63.1

(56) References Cited

U.S. PATENT DOCUMENTS 6,457,388 B1 * 10/2002 Chen ..... 81/63.2
6,457,389 B1 * 10/2002 Hu ..... 81/63.2
6,516,690 B2 * 2/2003 Chen ..... 81/63
6,644,148 B2 * 11/2003 Hu ..... 81/63.2
6,789,449 B2 * 9/2004 Liu ..... 81/63.2

* cited by examiner

*Primary Examiner*—Joseph J. Hail, III
*Assistant Examiner*—Alvin J. Grant

(57) ABSTRACT

A ratchet wrench includes a wrench body, a ratchet wheel, a pawl member, a control member, a direction control member, and a locking plate. Thus, the pawl member engages the ratchet wheel rigidly and closely, so that the pawl member and the ratchet wheel have the optimum locking state.

12 Claims, 18 Drawing Sheets

RATCHET WRENCH

BACKGROUND OF THE INVENTION

1. Field of the Invention

The present invention relates to a ratchet wrench, and more particularly to a ratchet wrench having the optimum locking state.

2. Description of the Related Art

A conventional ratchet wrench in accordance with the prior art comprises a wrench body, a ratchet wheel rotatably mounted in the wrench body, and a locking pawl pivotally mounted in the wrench body and engaged with the ratchet wheel. In operation, a workpiece, such as a screw member, is mounted in the ratchet wheel, so that the ratchet wheel can be used to rotate the workpiece by rotation of the wrench body.

However, only one side of the locking pawl is engaged with the ratchet wheel and the other side of the locking pawl is not in contact with the ratchet wheel, so that the locking pawl does not engage the ratchet wheel rigidly and closely. Thus, the locking pawl and the ratchet wheel do not form the optimum locking state.

The closest prior art of which the applicant is aware is disclosed in his U.S. Pat. No. 6,516,690.

SUMMARY OF THE INVENTION

The present invention is to mitigate and/or obviate the disadvantage of the conventional ratchet wrench.

The primary objective of the present invention is to provide a ratchet wrench, wherein the pawl member engages the ratchet wheel rigidly and closely, so that the pawl member and the ratchet wheel have the optimum locking state.

Another objective of the present invention is to provide a ratchet wrench, wherein the peripheral face of the control member is tangent to the arcuate concave face of the pawl member, so that when the control member is rested on the pawl member, the control member and the pawl member form a linear contact face, and the control member can be locked on and detached from the pawl member easily and conveniently.

In accordance with the present invention, there is provided a ratchet wrench, comprising a wrench body, a ratchet wheel, a pawl member, and a control member, wherein:

- the wrench body has an end formed with a receiving hole having a side formed with a receiving recess and a control recess located beside the receiving recess;
- the ratchet wheel is rotatably mounted in the receiving hole of the wrench body;
- the pawl member is pivotally mounted in the receiving recess of the wrench body and has a first side engaged with the ratchet wheel and a second side formed with an arcuate concave face;
- the control member is rotatably mounted in the control recess of the wrench body to control movement of the pawl member in the receiving recess of the wrench body;
- the control member has a peripheral face rested on the arcuate concave face of the pawl member; and
- the control member drives the pawl member to press a side face of the receiving recess of the wrench body and to engage the ratchet wheel.

Further benefits and advantages of the present invention will become apparent after a careful reading of the detailed description with appropriate reference to the accompanying drawings.

DETAILED DESCRIPTION OF THE INVENTION

Figure 1:
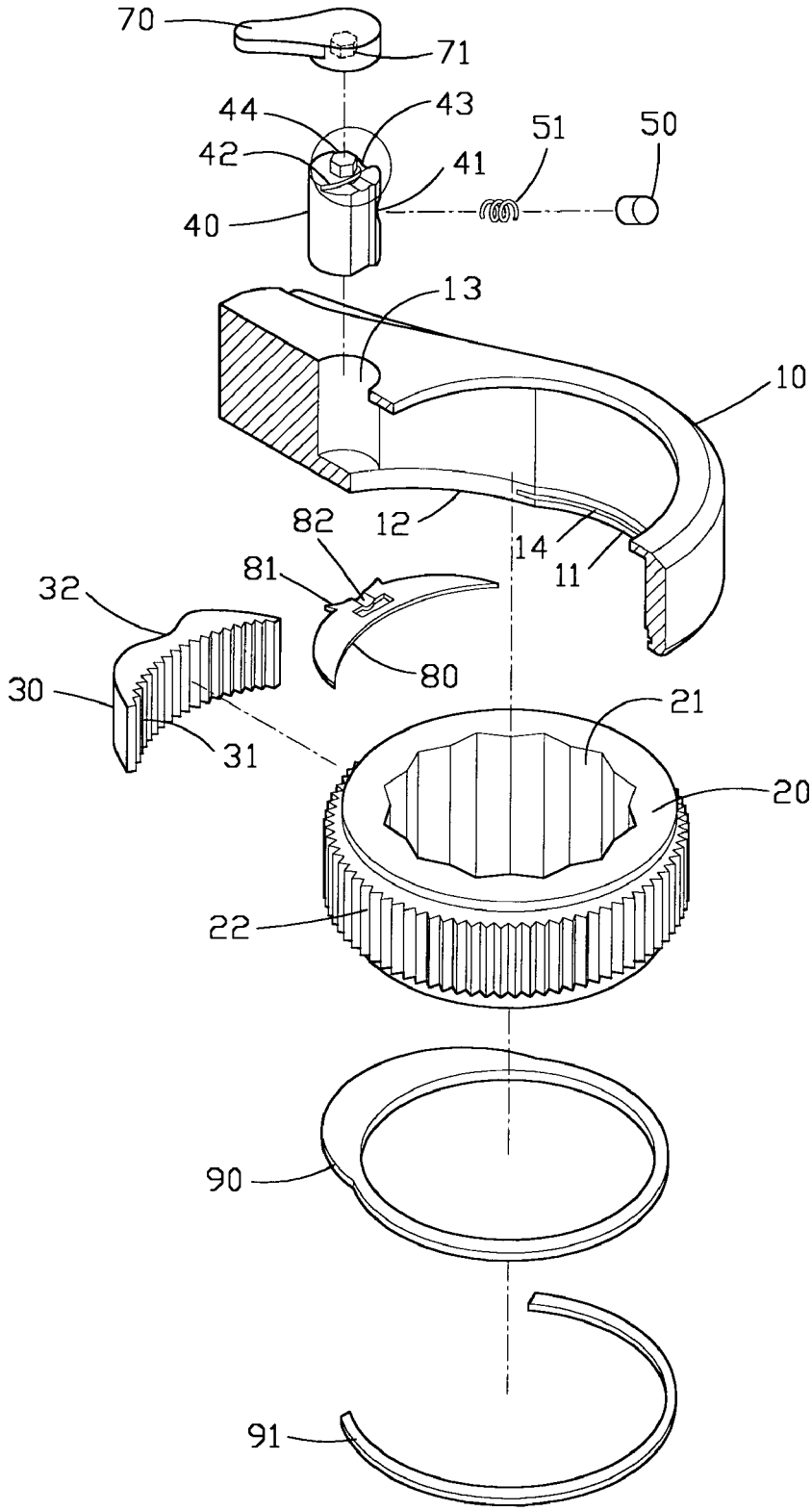
FIG. 1 is an exploded perspective view of the ratchet wrench in accordance with the first embodiment of the present invention.
Figure 2:
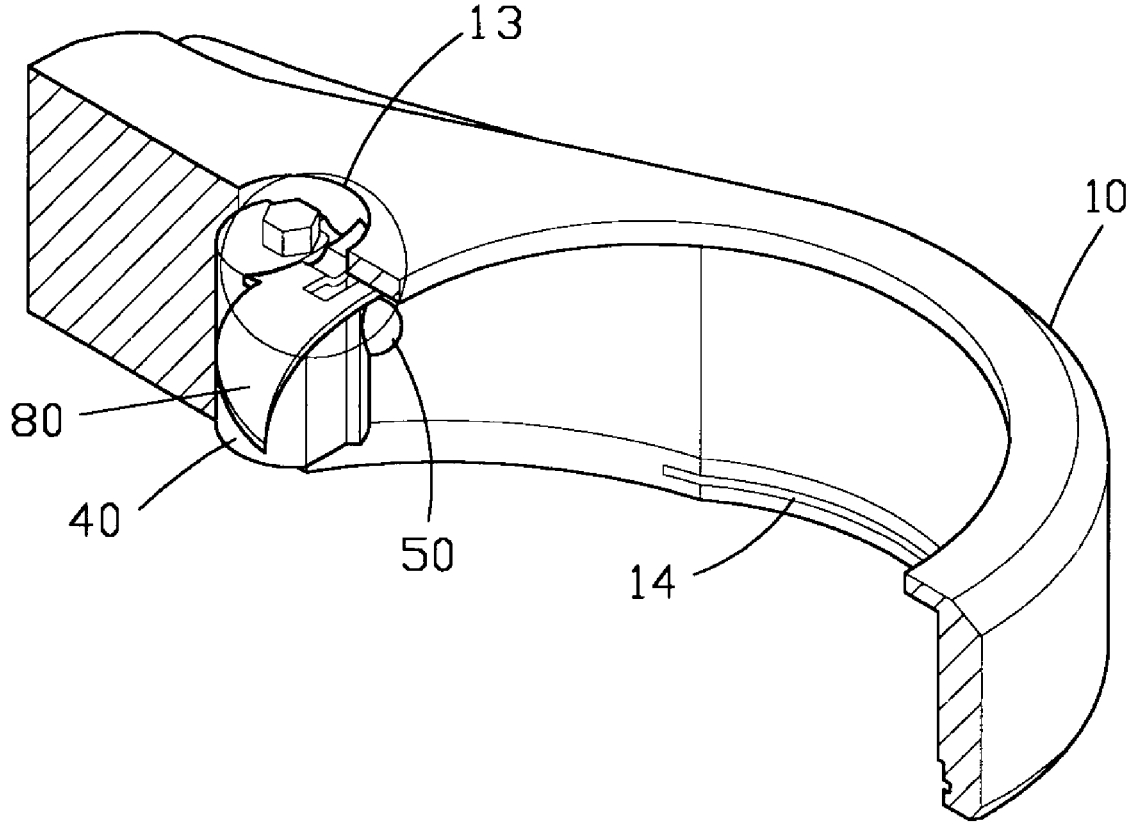
FIG. 2 is a partially perspective assembly view of the ratchet wrench as shown in FIG. 1.
Figure 3:
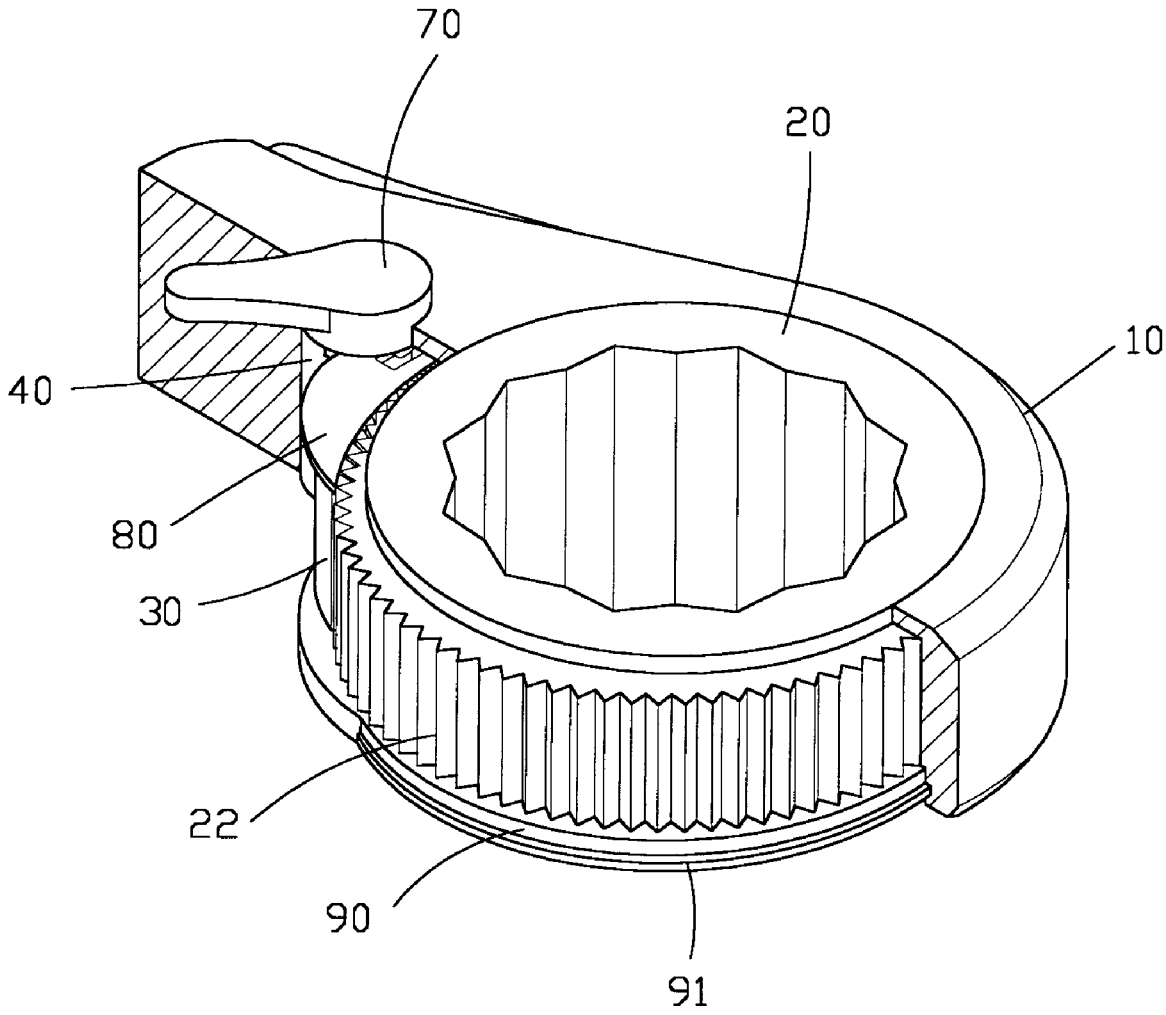
FIG. 3 is a partially cut-away perspective assembly view of the ratchet wrench as shown in FIG. 1.

Referring to the drawings and initially to FIGS. 1–3, a ratchet wrench in accordance with a first embodiment of the present invention comprises a wrench body 10, a ratchet wheel 20, a pawl member 30, a control member 40, a direction control member 70, and a locking plate 80.

The wrench body 10 has an end formed with a receiving hole 11. The receiving hole 11 of the wrench body 10 has a bottom formed with a snap groove 14 and has a side formed with a receiving recess 12 and a control recess 13 located beside the receiving recess 12. The control recess 13 of the wrench body 10 communicates with the receiving recess 12 of the wrench body 10.

The ratchet wheel 20 is rotatably mounted in the receiving hole 11 of the wrench body 10. The ratchet wheel 20 has an inner wall formed with a polygonal recess 21 and an outer wall provided with a plurality of ratchet teeth 22.

The pawl member 30 is pivotally mounted in the receiving recess 12 of the wrench body 10. The pawl member 30 has a first side provided with a plurality of locking teeth 31 meshing with the ratchet teeth 22 of the ratchet wheel 20 and a second side formed with an arcuate concave face 32.

Figure 1A:
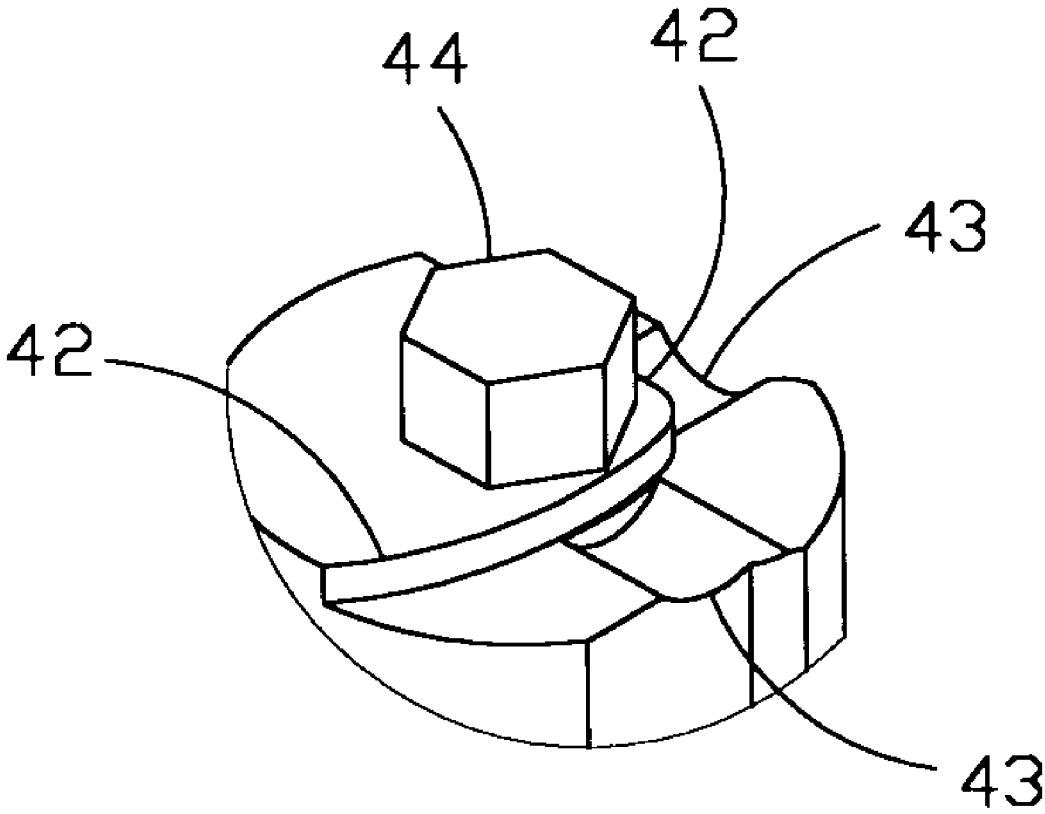
FIG. 1A is a partially enlarged view of the ratchet wrench as shown in FIG. 1.

The control member 40 is rotatably mounted in the control recess 13 of the wrench body 10 to control movement of the pawl member 30 in the receiving recess 12 of the wrench body 10. The control member 40 has a peripheral face rested on the arcuate concave face 32 of the pawl member 30. The control member 40 has an upper end formed with two abutting faces 42 (see FIG. 1A) and two concave portions 43 each aligning with a respective one of the two abutting faces 42. The control member 40 has a top formed with a polygonal protruding stud 44. The control member 40 is formed with a receiving chamber 41.

The ratchet wrench further comprises an urging cap 50 movably mounted in the receiving chamber 41 of the control member 40 and urged on the arcuate concave face 32 of the pawl member 30 to force the pawl member 30 to engage the ratchet wheel 20.

The ratchet wrench further comprises an elastic member 51 mounted in the receiving chamber 41 of the control member 40 and urged on the urging cap 50 to move the urging cap 50 toward the arcuate concave face 32 of the pawl member 30.

The direction control member 70 is rotatably mounted on the wrench body 10 and secured on the top of the control member 40 for rotating the control member 40. The direction control member 70 has a bottom formed with a polygonal recess 71 for securing the protruding stud 44 of the control member 40.

Figure 2A:
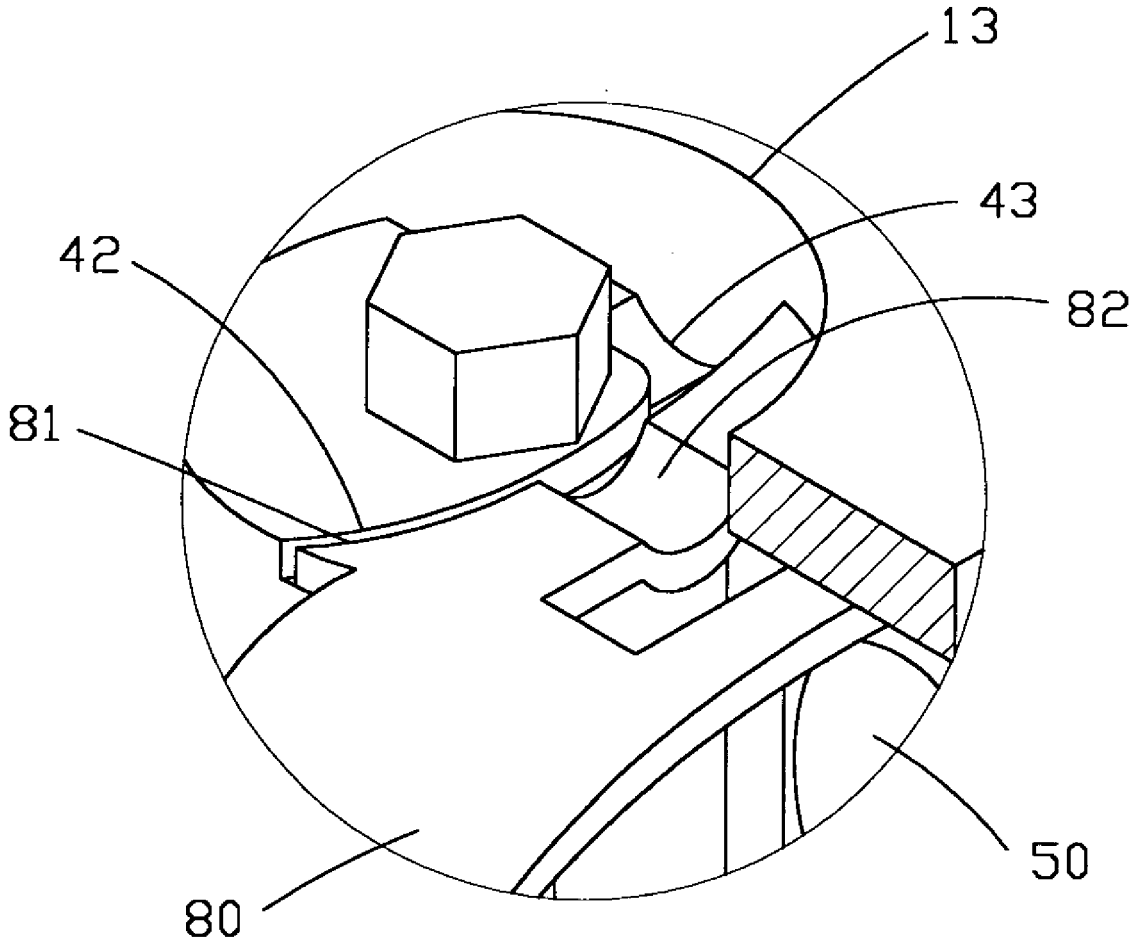
FIG. 2A is a partially enlarged view of the ratchet wrench as shown in FIG. 2.

The locking plate 80 made of an elastic material is secured in the receiving recess 12 of the wrench body 10 and locked between the direction control member 70 and the control member 40. The locking plate 80 has a side formed with an abutting edge 81 (see FIG. 2A) rested on one of the two abutting faces 42 of the control member 40. The locking plate 80 is provided with a convex portion 82 (see FIG. 2A) secured in the respective concave portion 43 of the control member 40.

The ratchet wrench further comprises a bottom cover 90 secured in the receiving recess 12 of the wrench body 10 and rested on a bottom of the ratchet wheel 20.

The ratchet wrench further comprises a snap ring 91 secured in the snap groove 14 of the wrench body 10 and rested on a bottom of the bottom cover 90.

In assembly, the control member 40 is placed in the control recess 13 of the wrench body 10. Then, the locking plate 80 is secured in the receiving recess 12 of the wrench body 10, with the abutting edge 81 of the locking plate 80 being rested on the respective abutting face 42 of the control member 40 to prevent the control member 40 from detaching from the control recess 13 of the wrench body 10. At this time, the convex portion 82 of the locking plate 80 is secured in the respective concave portion 43 of the control member 40. Then, the urging cap 50 and the elastic member 51 are mounted in the receiving chamber 41 of the control member 40 to form a sub-assembly as shown in FIG. 2. Then, the pawl member 30, the ratchet wheel 20, the bottom cover 90, the snap ring 91 and the direction control member 70 are in turn mounted on the wrench body 10, thereby forming the ratchet wrench as shown in FIG. 3.

Figure 4:
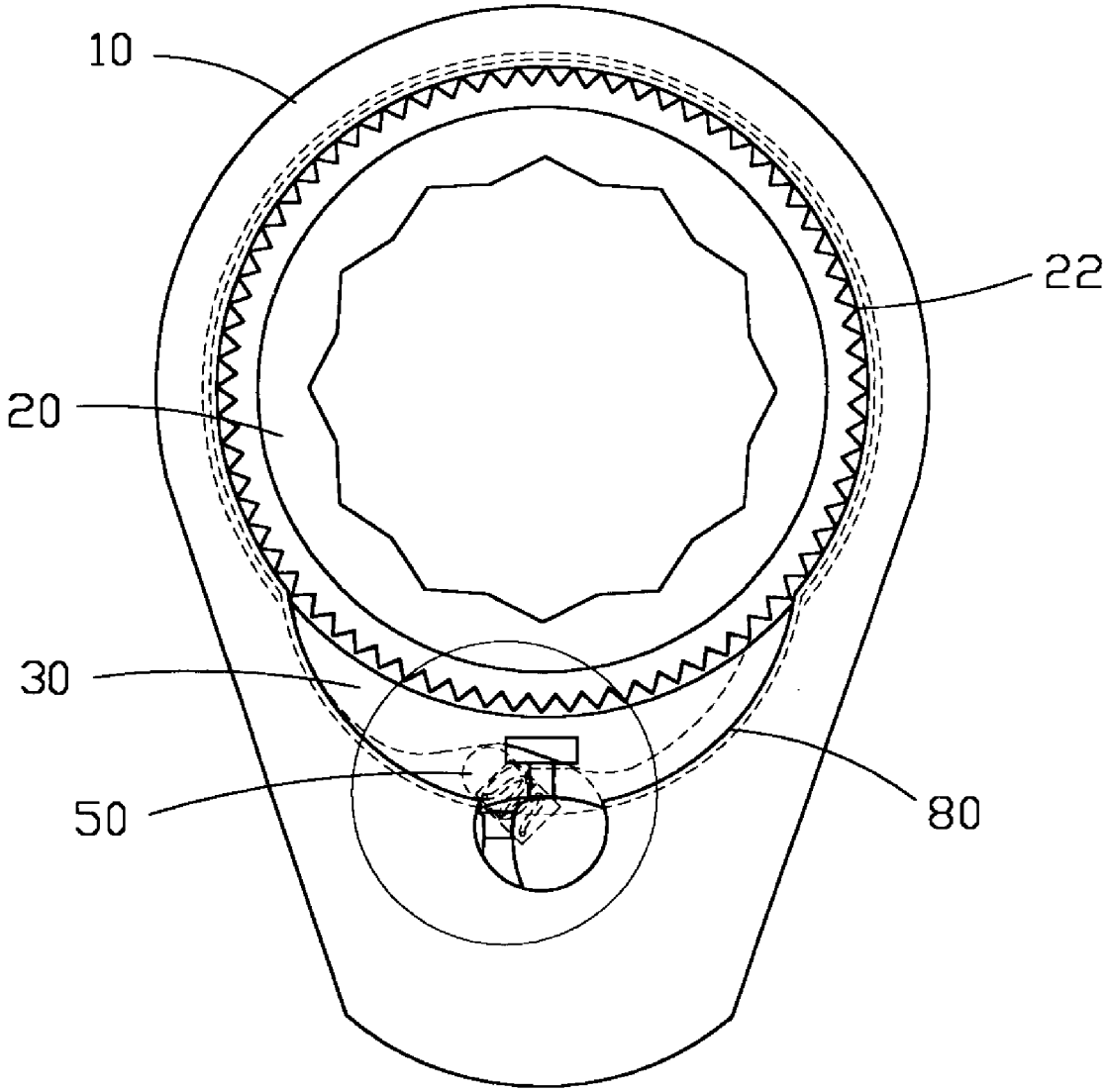
FIG. 4 is a top plan assembly view of the ratchet wrench as shown in FIG. 1.
Figure 4A:
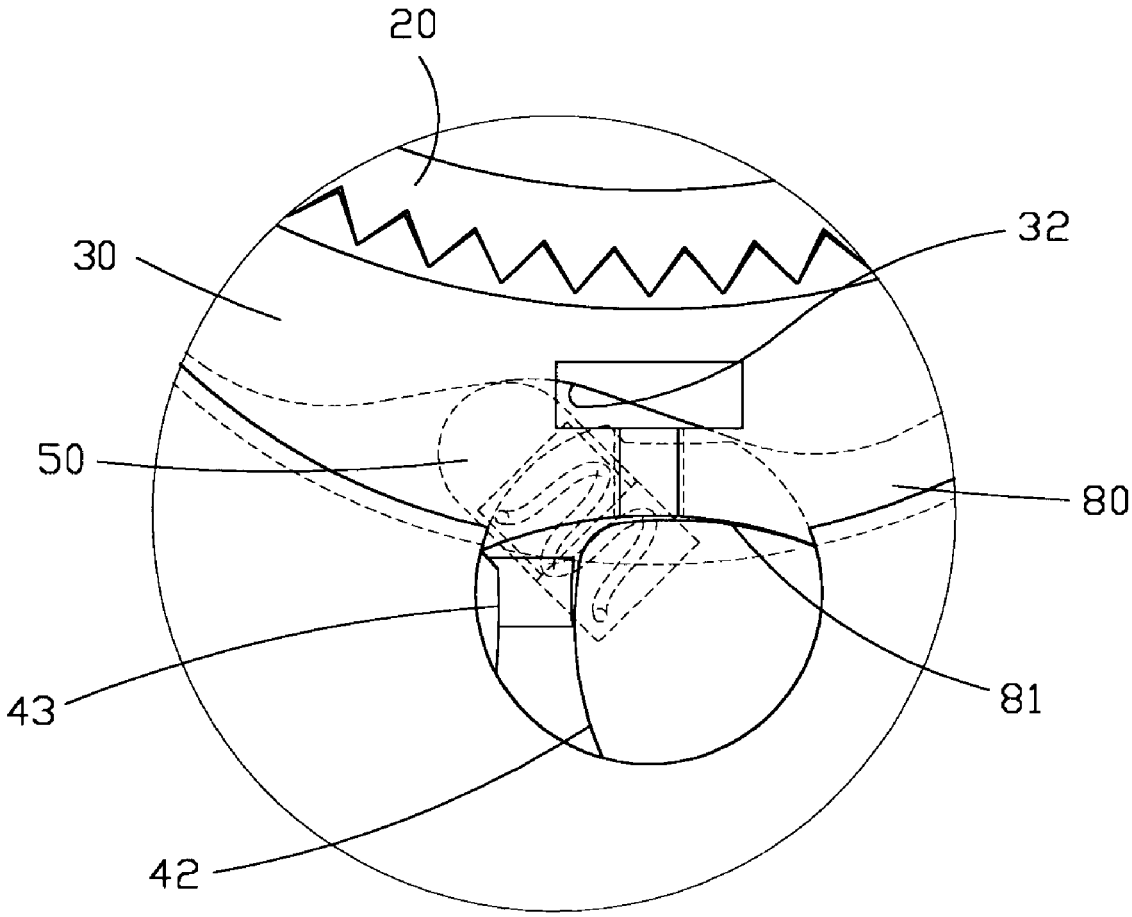
FIG. 4A is a partially enlarged view of the ratchet wrench as shown in FIG. 4.

Referring to FIGS. 4 and 4A with reference to FIGS. 1 and 2, the direction control member 70 is rotated in a first direction to rotate the control member 40 until one concave portion 43 of the control member 40 is positioned on the convex portion 82 of the locking plate 80, so that the control member 40 is positioned on the locking plate 80. At the same time, one abutting face 42 of the control member 40 is locked with the abutting edge 81 of the locking plate 80 during rotation of the control member 40 so as to control the maximum rotation angle of the control member 40, thereby preventing the urging cap 50 from hitting the side face of the receiving recess 12 of the wrench body 10. At this time, the urging cap 50 drives the pawl member 30 to press a side face of the receiving recess 12 of the wrench body 10 and to engage the ratchet wheel 20, so that the ratchet wheel 20 can be driven by the wrench body 10 to rotate clockwise as shown in FIG. 4.

Figure 5:
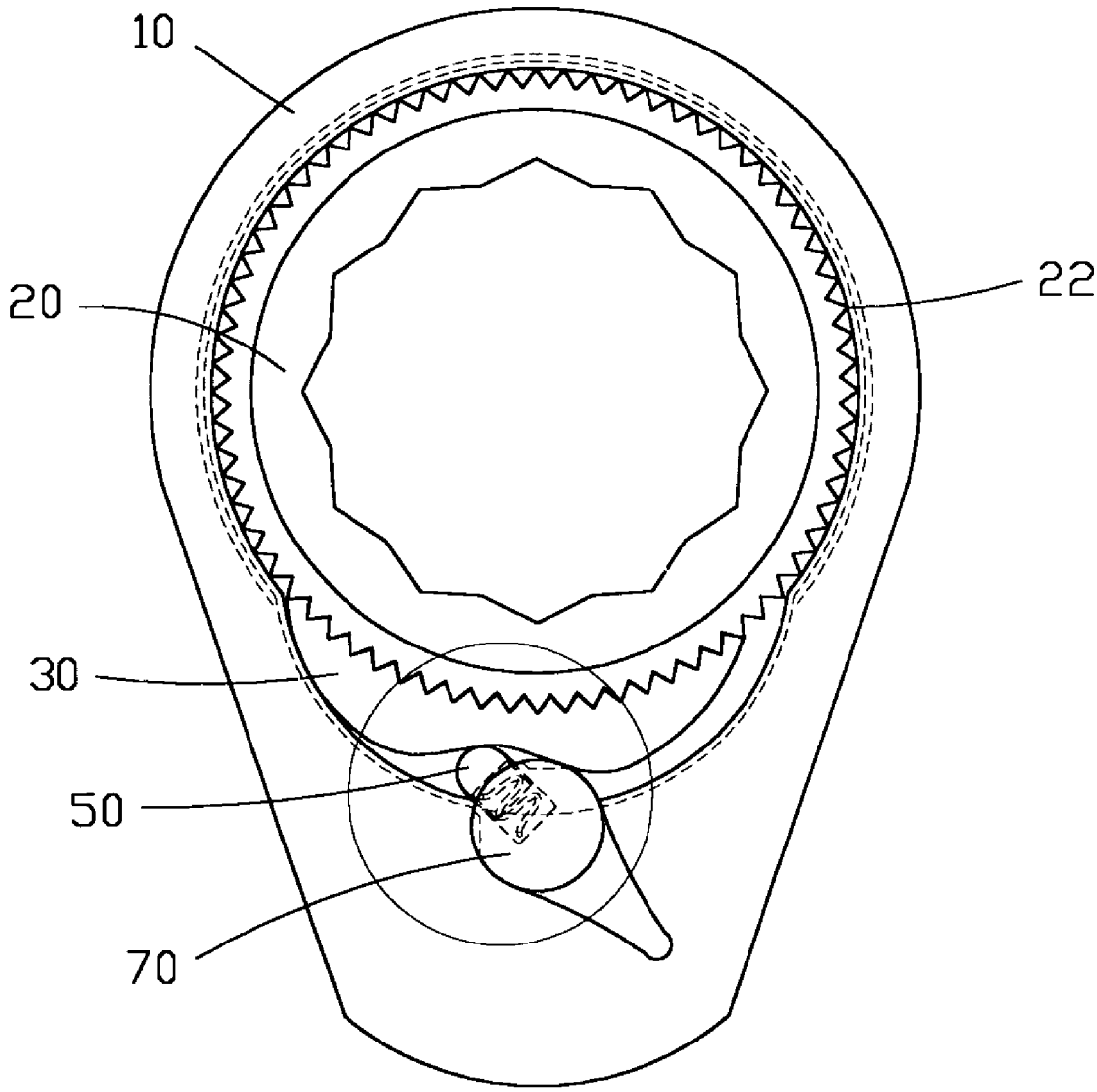
FIG. 5 is a top plan assembly view of the ratchet wrench as shown in FIG. 1.
Figure 5A:
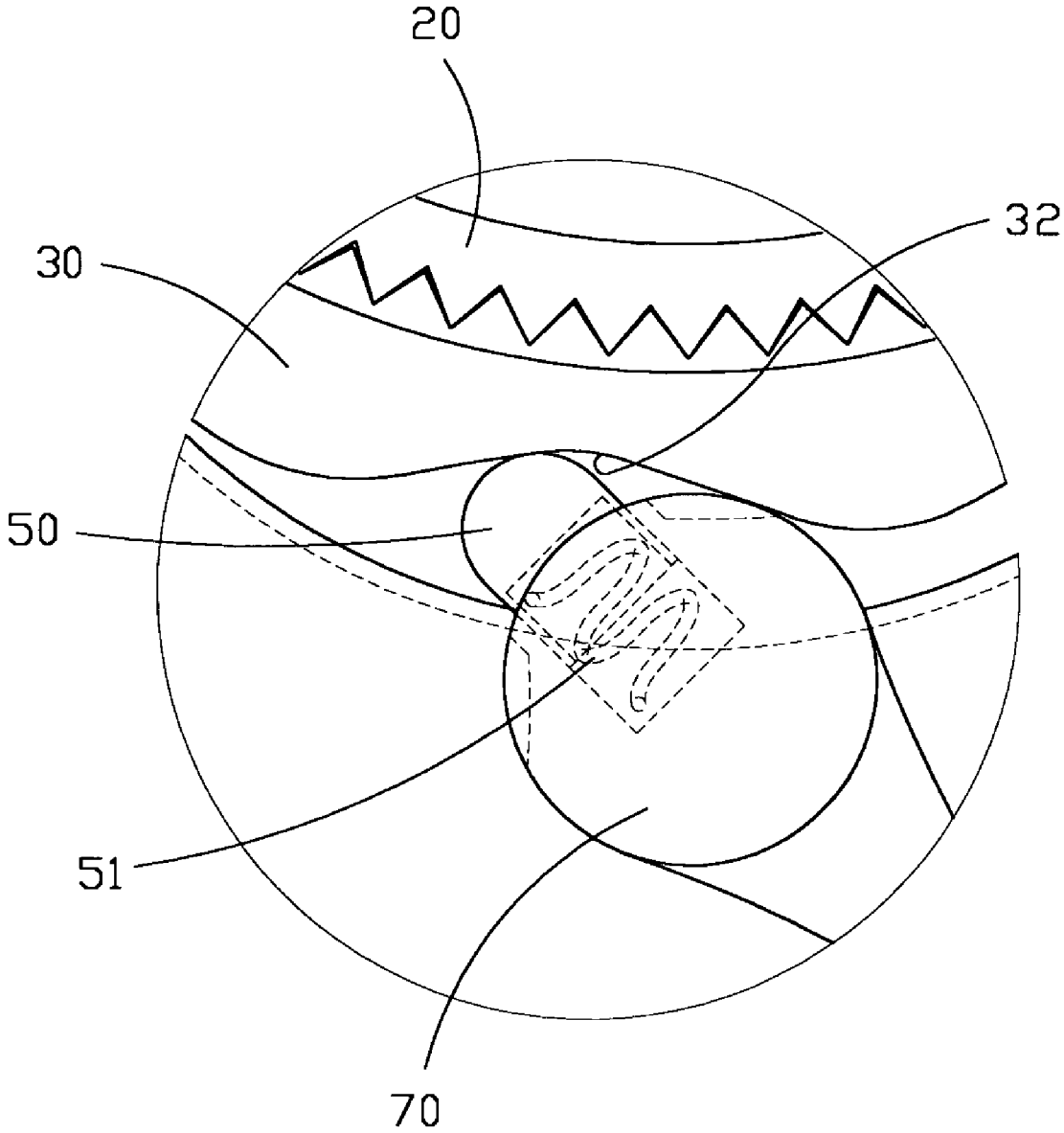
FIG. 5A is a partially enlarged view of the ratchet wrench as shown in FIG. 5.
Figure 6:
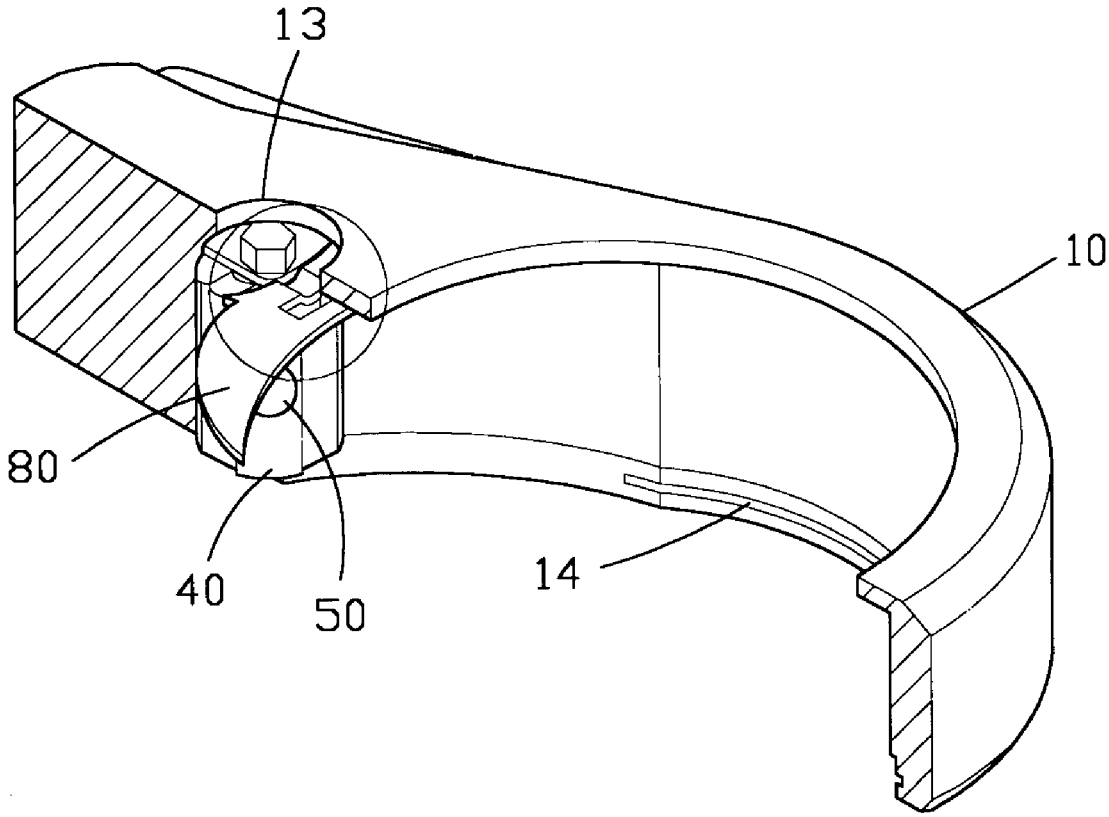
FIG. 6 is a partially perspective assembly view of the ratchet wrench as shown in FIG. 1.
Figure 6A:
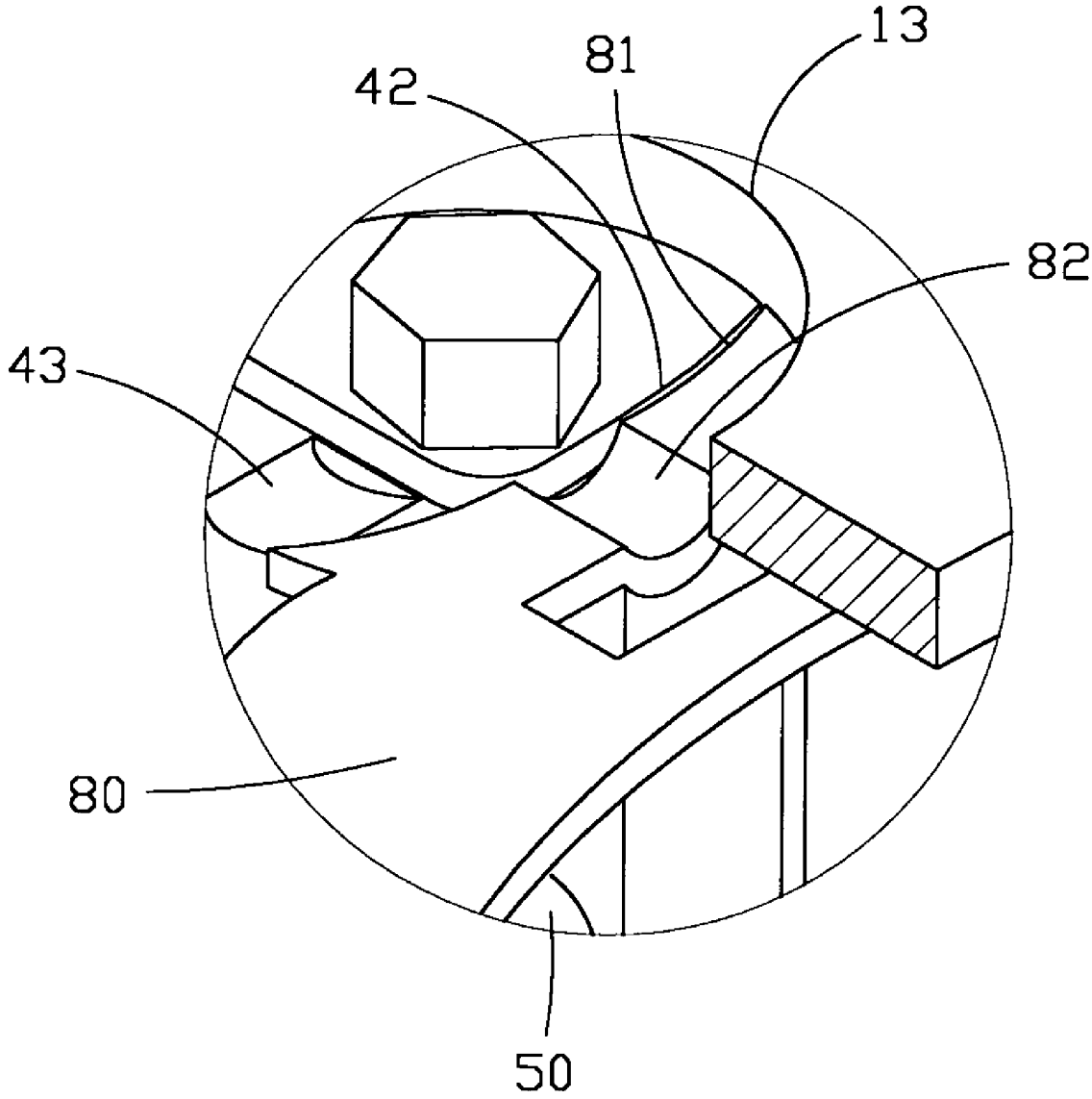
FIG. 6A is a partially enlarged view of the ratchet wrench as shown in FIG. 6.

Referring to FIGS. 5 and 5A with reference to FIGS. 1 and 2, the urging cap 50 is rested on a first side of the arcuate concave face 32 of the pawl member 30 to drive the pawl member 30 to press a side face of the receiving recess 12 of the wrench body 10 and to engage the ratchet wheel 20, and the control member 40 has a peripheral face rested on a second side of the arcuate concave face 32 of the pawl member 30, so that the pawl member 30 engages the ratchet wheel 20 rigidly and closely. Preferably, the peripheral face of the control member 40 has a cylindrical shape. In addition, the peripheral face of the control member 40 is tangent to the second side of the arcuate concave face 32 of the pawl member 30, so that when the control member 40 is rested on the pawl member 30, the control member 40 and the pawl member 30 form a linear contact face. Thus, the control member 40 is locked on and detached from the pawl member 30 easily and conveniently.

Figure 7:
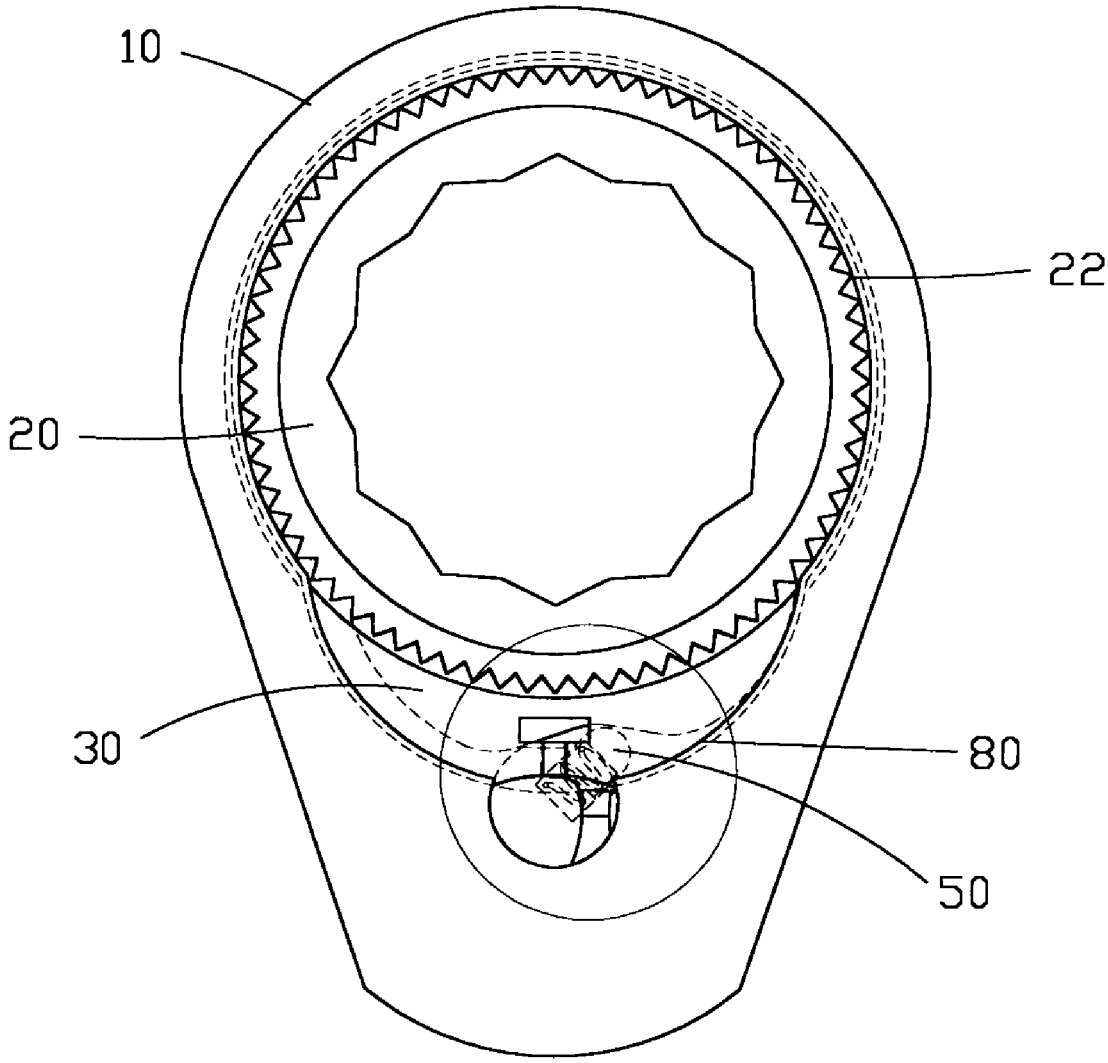
FIG. 7 is a top plan assembly view of the ratchet wrench as shown in FIG. 1.
Figure 7A:
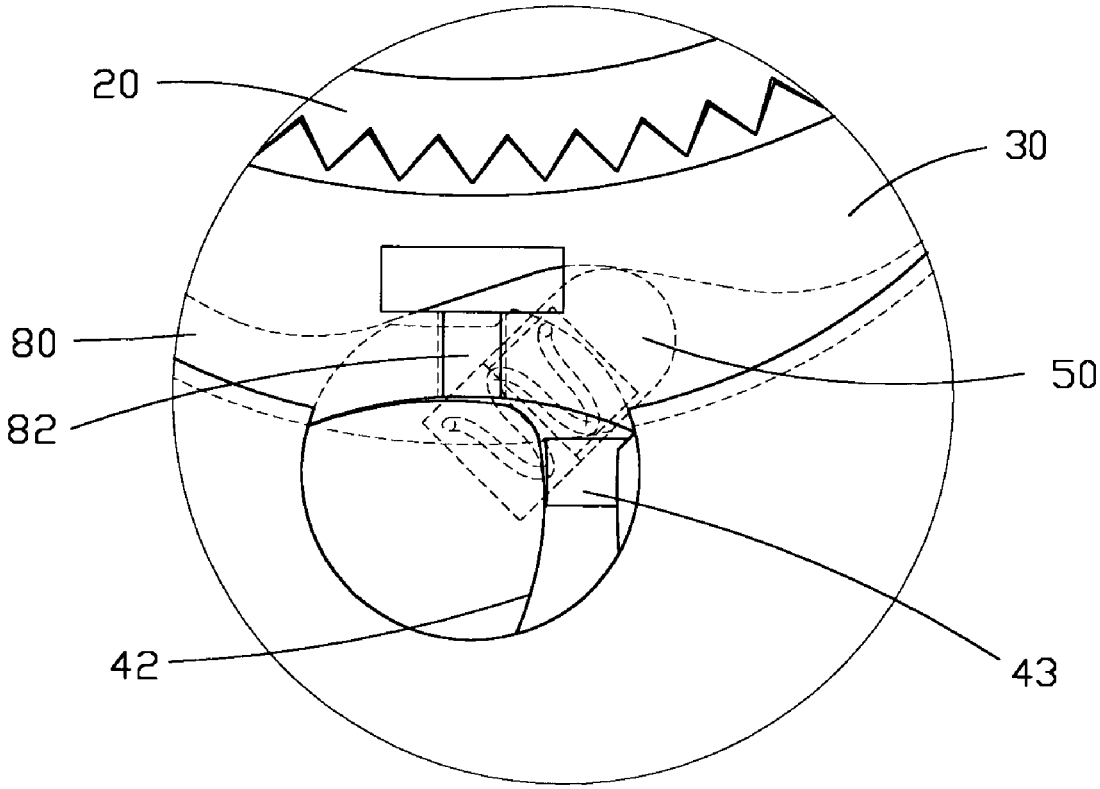
FIG. 7A is a partially enlarged view of the ratchet wrench as shown in FIG. 7.

Referring to FIGS. 6, 6A, 7 and 7A with reference to FIGS. 1 and 2, the direction control member 70 is rotated in a second direction to rotate the control member 40 until the other concave portion 43 of the control member 40 is positioned on the convex portion 82 of the locking plate 80, so that the control member 40 is positioned on the locking plate 80. At the same time, the other abutting face 42 of the control member 40 is locked with the abutting edge 81 of the locking plate 80 during rotation of the control member 40 so as to control the maximum rotation angle of the control member 40, thereby preventing the urging cap 50 from hitting the side face of the receiving recess 12 of the wrench body 10. At this time, the urging cap 50 drives the pawl member 30 to press a side face of the receiving recess 12 of the wrench body 10 and to engage the ratchet wheel 20, so that the ratchet wheel 20 can be driven by the wrench body 10 to rotate counterclockwise as shown in FIG. 7.

Figure 8:
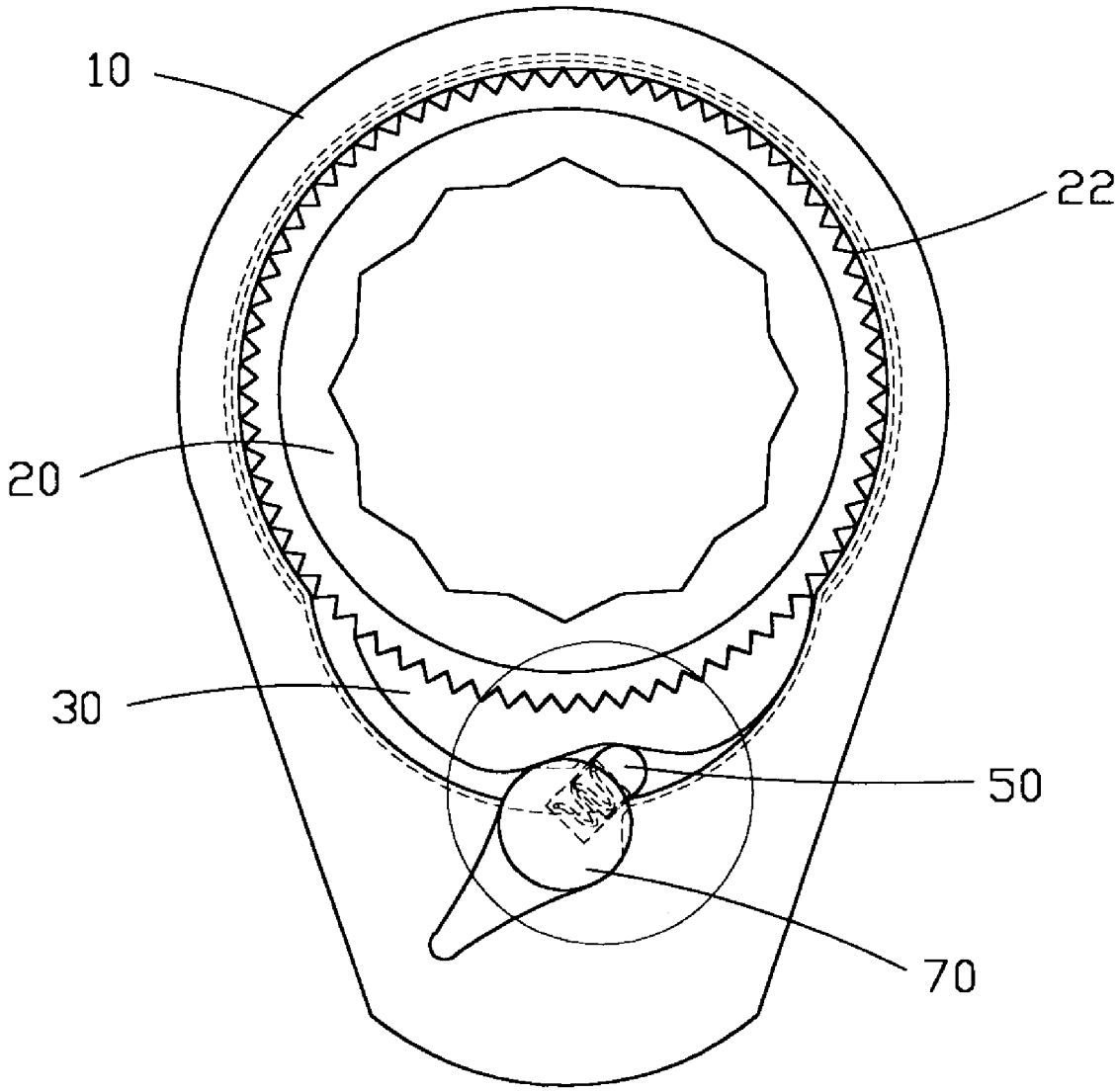
FIG. 8 is a top plan assembly view of the ratchet wrench as shown in FIG. 1.
Figure 8A:
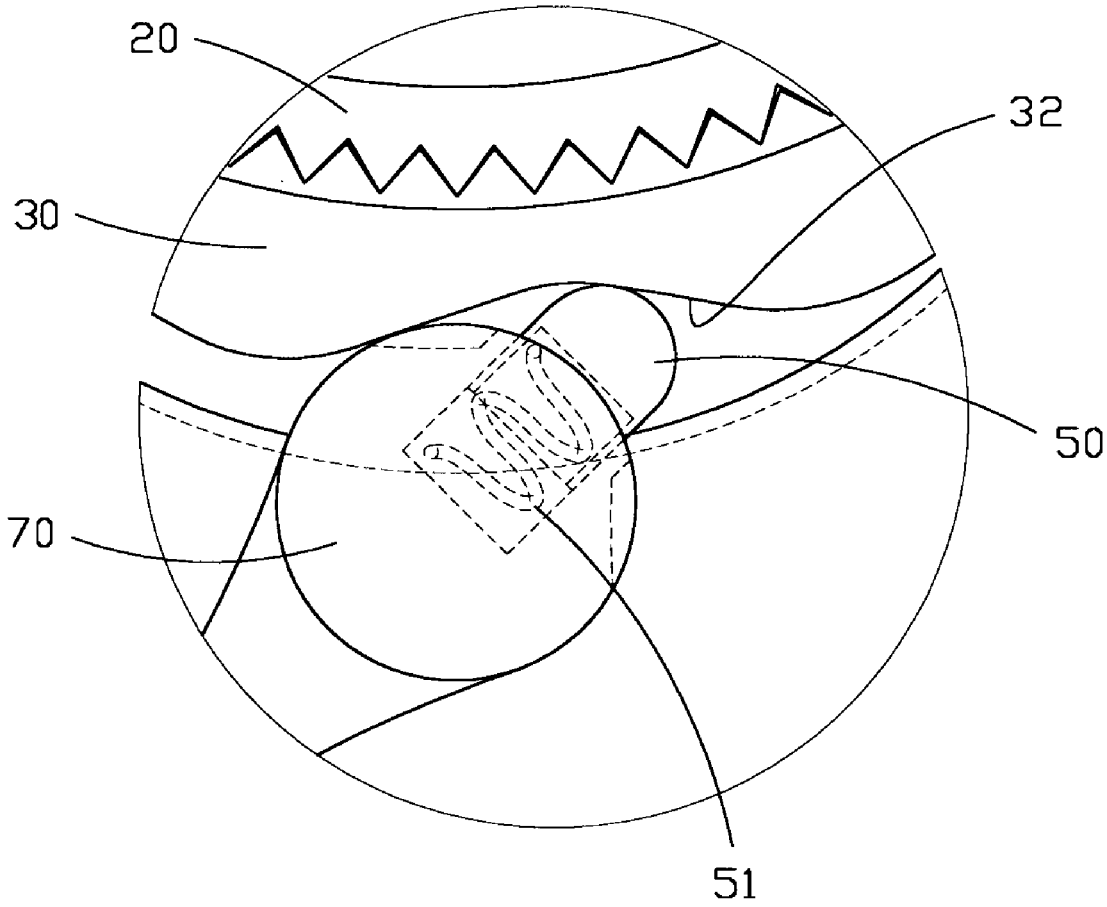
FIG. 8A is a partially enlarged view of the ratchet wrench as shown in FIG. 8.

Referring to FIGS. 8 and 8A with reference to FIGS. 1 and 2, the urging cap 50 is rested on the second side of the arcuate concave face 32 of the pawl member 30 to drive the pawl member 30 to press a side face of the receiving recess 12 of the wrench body 10 and to engage the ratchet wheel 20, and the control member 40 has a peripheral face rested on the first side of the arcuate concave face 32 of the pawl member 30, so that the pawl member 30 engages the ratchet wheel 20 rigidly and closely. In addition, the peripheral face of the control member 40 is tangent to the first side of the arcuate concave face 32 of the pawl member 30, so that when the control member 40 is rested on the pawl member 30, the control member 40 and the pawl member 30 form a linear contact face. Thus, the control member 40 is locked on and detached from the pawl member 30 easily and conveniently.

Figure 9:
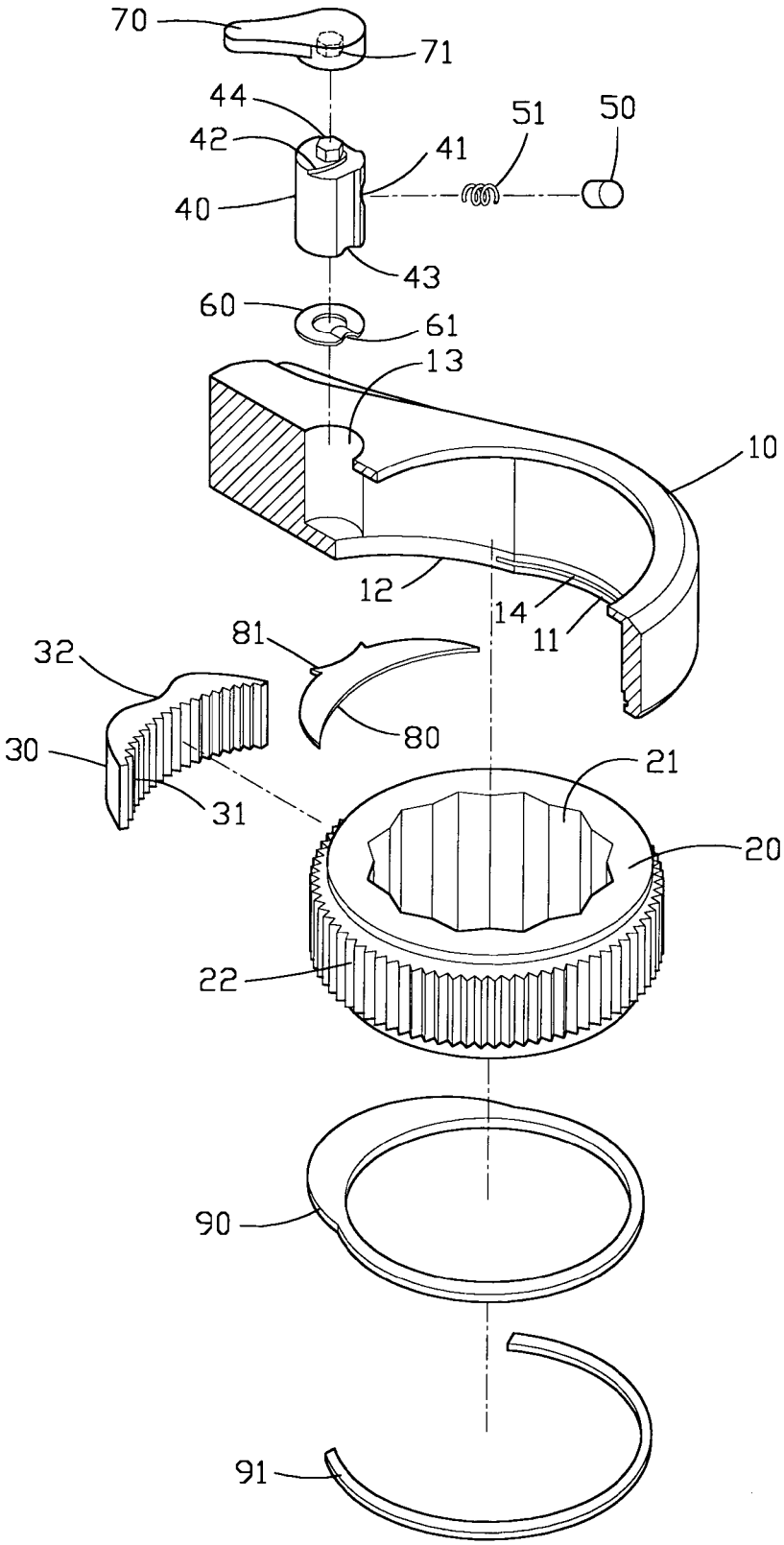
FIG. 9 is an exploded perspective view of the ratchet wrench in accordance with the second embodiment of the present invention.
Figure 10:
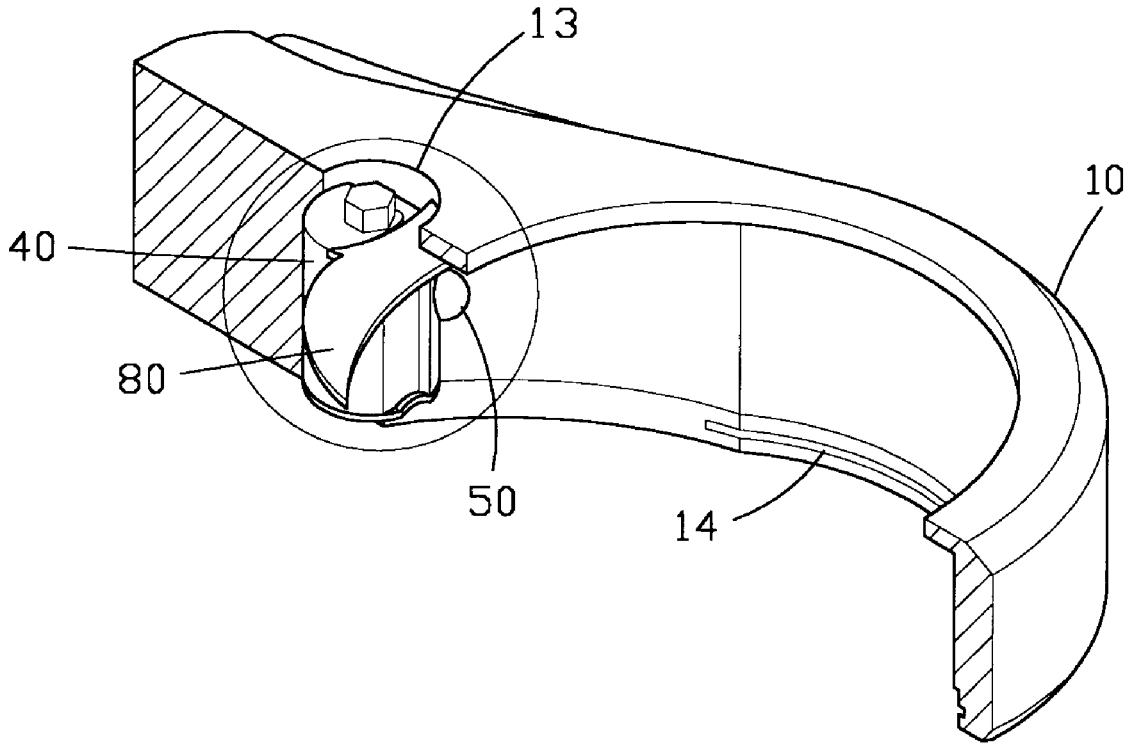
FIG. 10 is a partially perspective assembly view of the ratchet wrench as shown in FIG. 9.
Figure 10A:
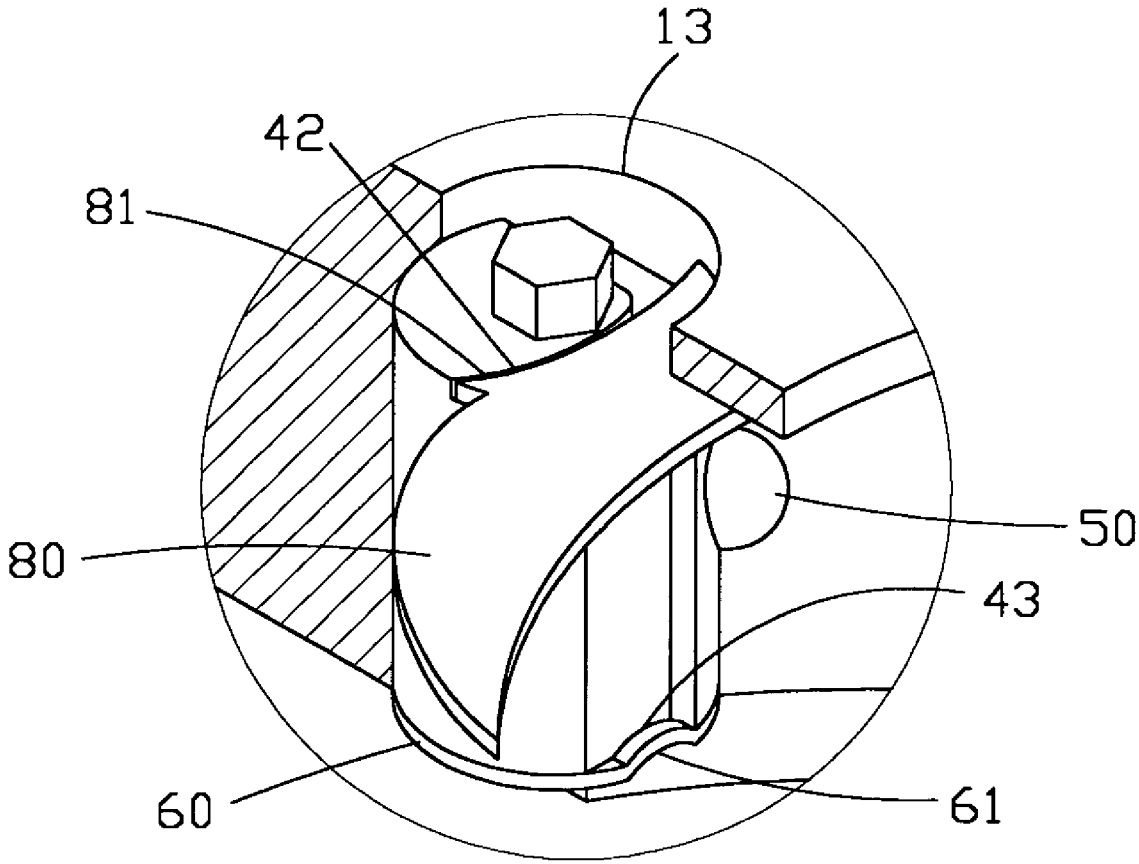
FIG. 10A is a partially enlarged view of the ratchet wrench as shown in FIG. 10.

Referring to FIGS. 9, 10 and 10A, the ratchet wrench in accordance with the second embodiment of the present invention is shown, wherein the control member 40 has a bottom formed with two concave portions 43, and the convex portion 82 of the locking plate 80 is undefined. The ratchet wrench further comprises an elastic plate 60 secured in the receiving recess 12 of the wrench body 10 and provided with a convex portion 61 positioned in one of the two concave portions 43 of the control member 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench, comprising a wrench body, a ratchet wheel, a pawl member, and a control member, wherein:

the wrench body has an end formed with a receiving hole having a side formed with a receiving recess and a control recess located beside the receiving recess;

the ratchet wheel is rotatably mounted in the receiving hole of the wrench body;

the pawl member is pivotally mounted in the receiving recess of the wrench body and has a first side engaged with the ratchet wheel and a second side formed with an arcuate concave face;

the control member is rotatably mounted in the control recess of the wrench body to control movement of the pawl member in the receiving recess of the wrench body;

the control member has a peripheral face rested on the arcuate concave face of the pawl member;

the control member drives the pawl member to press a side face of the receiving recess of the wrench body and to engage the ratchet wheel;

the ratchet wrench further comprises a locking plate made of an elastic material secured in the receiving recess of the wrench body and rested on the control member for positioning the control member.

2. The ratchet wrench in accordance with claim 1, wherein the control member is formed with a receiving chamber, and the ratchet wrench further comprises an urging cap movably mounted in the receiving chamber of the control member and urged on the arcuate concave face of the pawl member to force the pawl member to engage the ratchet wheel.

3. The ratchet wrench in accordance with claim 2, wherein the urging cap is rested on a first side of the arcuate concave face of the pawl member to drive the pawl member to press a side face of the receiving recess of the wrench body and to engage the ratchet wheel, and the peripheral face of the control member is rested on a second side of the arcuate concave face of the pawl member.

4. The ratchet wrench in accordance with claim 2, further comprising an elastic member mounted in the receiving chamber of the control member and urged on the urging cap to move the urging cap toward the arcuate concave face of the pawl member.

5. The ratchet wrench in accordance with claim 1, wherein the control member has an upper end formed with two abutting faces and two concave portions each aligning with a respective one of the two abutting faces, and the locking plate has a side formed with an abutting edge rested on one of the two abutting faces of the control member and is provided with a convex portion secured in one of the two concave portions of the control member.

6. The ratchet wrench in accordance with claim 1, further comprising a bottom cover secured in the receiving recess of the wrench body and rested on a bottom of the ratchet wheel.

7. The ratchet wrench in accordance with claim 6, wherein the receiving hole of the wrench body has a bottom formed with a snap groove, and the ratchet wrench further comprises a snap ring secured in the snap groove of the wrench body and rested on a bottom of the bottom cover.

8. The ratchet wrench in accordance with claim 1, wherein the peripheral face of the control member has a cylindrical shape and is tangent to the arcuate concave face of the pawl member, so that when the control member is rested on the pawl member, the control member and the pawl member form a linear contact face.

9. The ratchet wrench in accordance with claim 1, wherein the ratchet wheel has an inner wall formed with a polygonal recess and an outer wall provided with a plurality of ratchet teeth.

10. The ratchet wrench in accordance with claim 1, wherein the first side of the pawl member is provided with a plurality of locking teeth meshing with the ratchet teeth of the ratchet wheel.

11. A ratchet wrench, comprising a wrench body, a ratchet wheel, a pawl member, and a control member, wherein:

the wrench body has an end formed with a receiving hole having a side formed with a receiving recess and a control recess located beside the receiving recess;

the ratchet wheel is rotatably mounted in the receiving hole of the wrench body;

the pawl member is pivotally mounted in the receiving recess of the wrench body and has a first side engaged with the ratchet wheel and a second side formed with an arcuate concave face;

the control member is rotatably mounted in the control recess of the wrench body to control movement of the pawl member in the receiving recess of the wrench body;

the control member has a peripheral face rested on the arcuate concave face of the pawl member;

the control member drives the pawl member to press a side face of the receiving recess of the wrench body and to engage the ratchet wheel;

a direction control member is rotatably mounted on the wrench body and secured on the top of the control member for rotating the control member;

the control member has a top formed with a polygonal protruding stud, and the direction control member has a bottom formed with a polygonal recess for securing the protruding stud of the control member.

12. A ratchet wrench, comprising a wrench body, a ratchet wheel, a pawl member, and a control member, wherein:

the wrench body has an end formed with a receiving hole having a side formed with a receiving recess and a control recess located beside the receiving recess;

the ratchet wheel is rotatably mounted in the receiving hole of the wrench body;

the pawl member is pivotally mounted in the receiving recess of the wrench body and has a first side engaged with the ratchet wheel and a second side formed with an arcuate concave face;

the control member is rotatably mounted in the control recess of the wrench body to control movement of the pawl member in the receiving recess of the wrench body;

the control member has a peripheral face rested on the arcuate concave face of the pawl member;

the control member drives the pawl member to press a side face of the receiving recess of the wrench body and to engage the ratchet wheel;

the control member has a bottom formed with two concave portions, and the ratchet wrench further comprises an elastic plate secured in the receiving recess of the wrench body and provided with a convex portion positioned in one of the two concave portions of the control member.

* * * * *